United States Patent [19]

Michaud

[11] Patent Number: 4,936,070

[45] Date of Patent: Jun. 26, 1990

[54] ROOF COVERING PANEL

[76] Inventor: Robert E. Michaud, 2500, Berthon/Longueuli/Quebec, Canada, J4M 1M7

[21] Appl. No.: 313,479

[22] Filed: Feb. 22, 1989

[51] Int. Cl.[5] ..... E04B 5/00

[52] U.S. Cl. ..... 52/408; 52/421

[58] Field of Search ..... 52/592, 516, 409, 408, 52/420; 428/490, 247, 331

[56] References Cited

U.S. PATENT DOCUMENTS

| | | | |
|---|---|---|---|
| 2,610,928 | 9/1952 | Greider et al. | 428/489 |
| 2,825,660 | 4/1958 | Roux | 428/490 |
| 3,111,787 | 11/1963 | Chamberlain | 52/409 |
| 3,270,476 | 9/1966 | Ensled et al. | 52/516 |
| 4,766,024 | 8/1988 | Nath et al. | 428/139 |

FOREIGN PATENT DOCUMENTS

| | | | |
|---|---|---|---|
| 815221 | 7/1969 | Canada . | |
| 875810 | 7/1971 | Canada . | |
| 914873 | 11/1972 | Canada . | |
| 717032 | 10/1954 | United Kingdom | 52/592 |

*Primary Examiner*—James L. Ridgill, Jr.
*Attorney, Agent, or Firm*—Roland L. Morneau

[57] ABSTRACT

A rectangular roof covering panel made of three superposed layers: a fiberboard layer, an adhesive layer and a blended bituminen elastomer layer. The blended bitumen layer has a ledge exceeding over two adjacent sides of the rectangular panel. The ledge is adapted to overlap the elastomer layer of an adjacent and contiguous panel and to be fused thereon with a blowtorch.

3 Claims, 2 Drawing Sheets

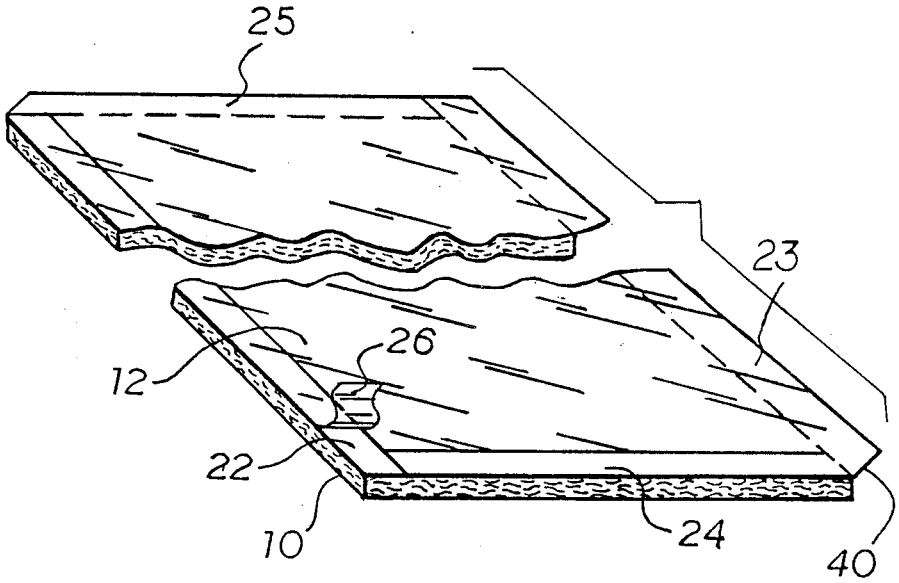

ROOF COVERING PANEL

BACKGROUND OF THE INVENTION

1. Field of the Invention

The invention relates to a roof covering panel made of an elastomeric membrane adhesively mounted on a fiberboard base. The covering panels are adjacently mounted and joined together by an overlapping strip of elastomer which can be heated with a blowtorch for binding the panels together.

2. Prior Art

U.S. Pat. No. 3,111,787 to Chamberlain discloses a combination of flet, plywood and a foam core. In this combination, the plywood makes the panel heavy, the felt is a flammable material not completely impervious to water and the foam core is a flammable material which is not indicated for the use of blowtorch contemplated by the applicant. The foam core is flexible and needs to be rigidify by the plywood.

Canadian Patent No. 815,221 discloses a roof covering element consisting of a bitumenous coating on a felt base provided with grooves for the passage of gases to prevent blisters.

In the panel disclosed by C. Skene in Canadian Patent No. 875,810 the base panel is made of a weak, flexible, insulating material of the expanded or foamed type covered with a bituminous material. Skene is particularly interested in a thermal insulation panel breathing through interconnecting grooves.

Edwin Mc Sween discloses, in Canadian Patent No. 914,873, a roof panel made of a closed cell water impermeable thermal insulation material sandwiched between a pair of felt layers. The felt layers overhangs two sidewalls. The panels are joined together by mopping an adhesive such as hot asphalt on the edges of each panels.

SUMMARY OF THE INVENTION

The roof covering panel according to the invention comprises an elastomeric membrane glued on a piece of fiberboard. The elastomeric membrane has a traction resistant base such as a non-woven polyester reinforcement coated with blended elastomer bitumen. The fiberboard is a lightweight and rigid board made of agglutined wood fibers. The glue provides a solid adherence of the membrane on the fiberboard and is compatible to both.

DETAILED DESCRIPTION OF THE INVENTION

Figure 1:
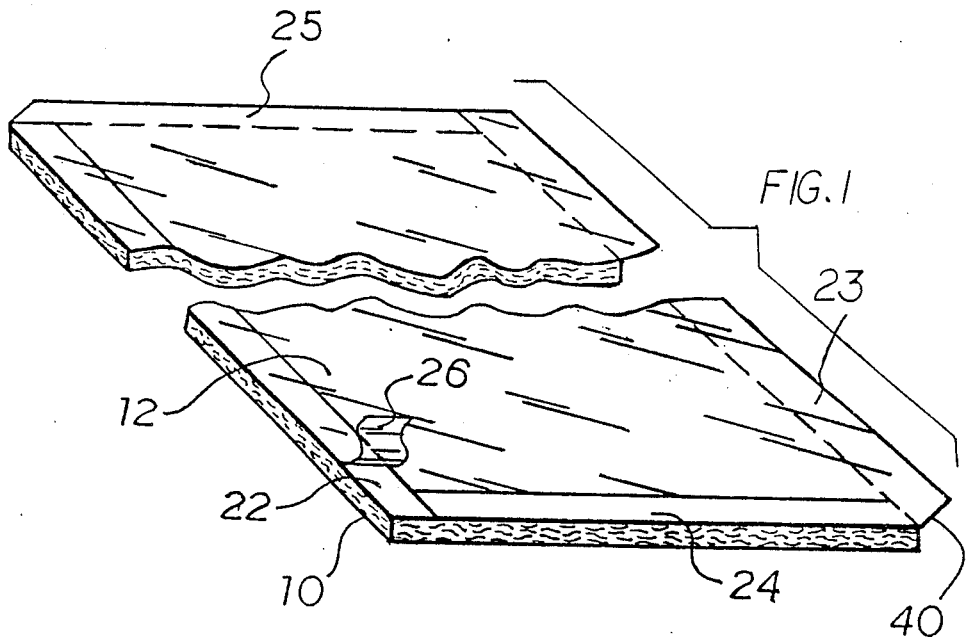
FIG. 1 is a perspective view of a roofing panel according to the invention.
Figure 2:
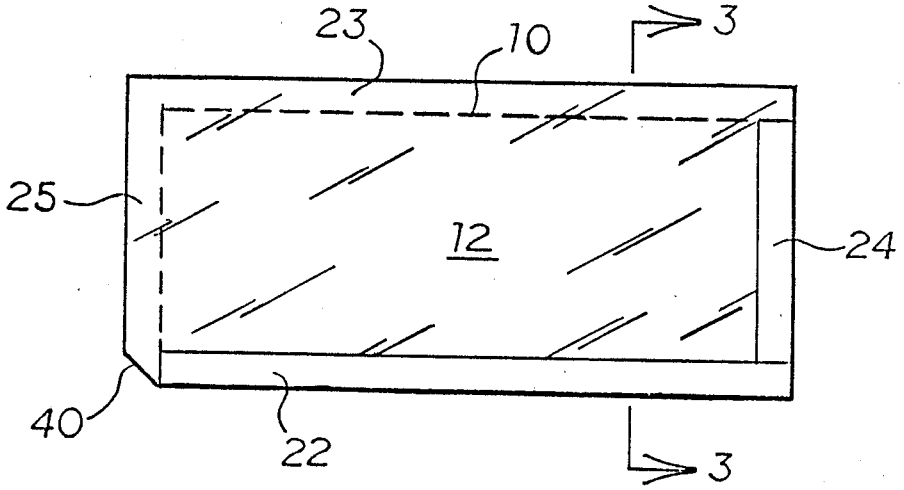
FIG. 2 is a top plan view of the panel shown in FIG. 1.
Figure 3:
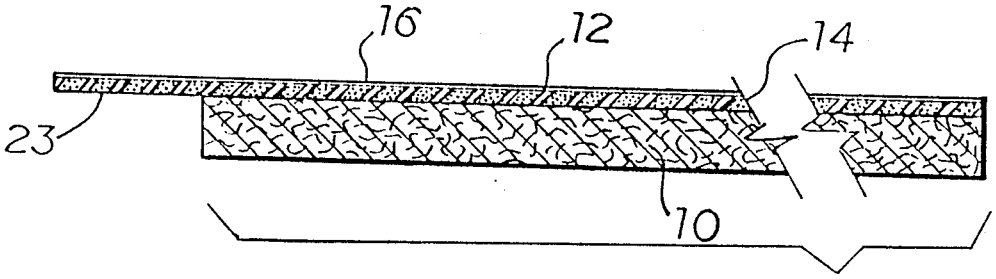
FIG. 3 is a cross-sectional view along line A—A of FIG. 2.

The panel shown in FIGS. 1, 2 and 3 is made of a fiberboard 10 on which is glued an elastomeric membrane 12. The fiberboards are rigid, lightweight panels made of agglutinated wood fibers substantially disposed isotropically. They have a low density for the purpose of the invention, the panels have a thickness of about ⅜ to ¾ in., are rectangular and usually cut to a dimension of 8 ft. by 3 to 4 feet. Although, it is referred to as rigid panels, they are slightly flexible particularly with a length of 8 feet. However, the flexibility of the fiberboard 10 is limited by the elastomeric membrane 12 explained later. A fiberboard having a thickness of ⅜ in. usually weights less than 1 lb per square foot. It is accordingly easy to manipulate.

The fiberboard 10 may also be made with a coating of asphalt to offer a better protection to the fibers on the surface of the board. This protection may be useful before the elastomeric membrane is applied but serves no purpose afterwards as far as the present invention is concerned.

The elastomeric membrane 12 used in the invention comprises a polyester reinforcement base preferable of the non-woven type. The polyester base is coated with blended elastomer bitumen. Elastophene 180 and Soprolene Flam 250 produced by the Soprema Etanchéité Inc. are two elastomeric membranes suitable for the present invention. The reinforcement base adds to the traction-resistance of the membrane and helps to maintain the shape of the membrane while providing a tight seal around a nail perforating the panel as further explained later. The elasticity of the membrane should remain satisfactory over a wide range of climatic temperatures usually withstood by a roof.

For the purpose of assembling the panels, the elastomeric membrane is selected for having a softening point above 100° C. and preferably between 110° C. and 130° C. The thickness of the membrane 12 may vary between 1 and 5 mm.

Figure 4:
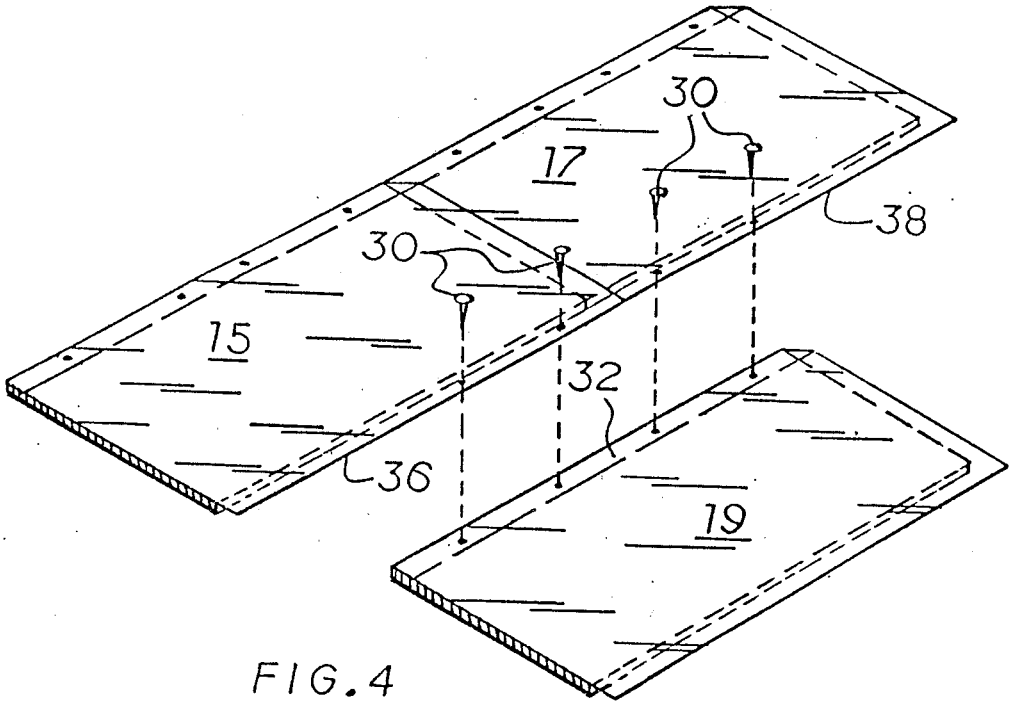
FIG. 4 is a perspective view of one end of a fiberboard covered with threads of glue.

The area of the membrane 12 exceed the area of the rectangular fiberboard 10 along two adjacent sides to form two laps 23 and 25 which are adapted to override an adjacent similar panel. Such an arrangement is illustrated in FIG. 4 by the three adjacent panels 15, 17 and 19. For a panel of 8 feet by 3 feet, the laps 23 and 25 have a width of approximately 3 to 4 inches.

The elastomer membrane 12 is bounded to the fiberboard with an adhesive which is compatible to both. The adhesive needs to have a viscosity which allows it to penetrate slightly into the fiberboard 10. A viscosity in the range of 15,000 mPa provides good results. The adhesive also needs to maintain a good elasticity, when dry, over a wide range of temperatures so that the panel can remain naturally flexible as a roof component.

The adhesive is expected to be substantially uninflammable because, as explained later, it may be exposed to a blowtorch. An adhesive having a water base is accordingly preferred. The compatibility of the adhesive in such that it should not produce a softening or a melting effect on the elastomer. An emulsified adhesive having an asphaltic and a latex base is suitable for this invention. Such an adhesive is produced by Bakelite Thermodurcies Limited under the trade name Bakelite No. 38. This adhesive can be spread at room temperature and should maintain its flexibility over a range of temperature corresponding to a cold and hot climate.

Asphalt may also be used as a binder but it needs to be heated and spread at about 350° F. to 400° F. for a satsifactory binding operation.

In order to prevent adhesion of the panels together when stored or piled up on account of the tacky top surface of the elastomer membrane, a thin plastic film 16 covers the later. The film 16 is thermofusible so as to melt when the membrane is heated by a blowtorch intended to soften the membrane 12.

The permanent adherence of the membrane 12 on the fiberboard 10 is obtained by depositing a layer of the adhesive 14 on the fiberboard 10, by laying the membrane 12 over it, and by letting it dry. The layer of adhesive 14 must be thick enough to allow a small amount to penetrate in the fiberboard while a sufficient thickness remains on the surface to allow the adherence of the membrane 12.

Figure 5:
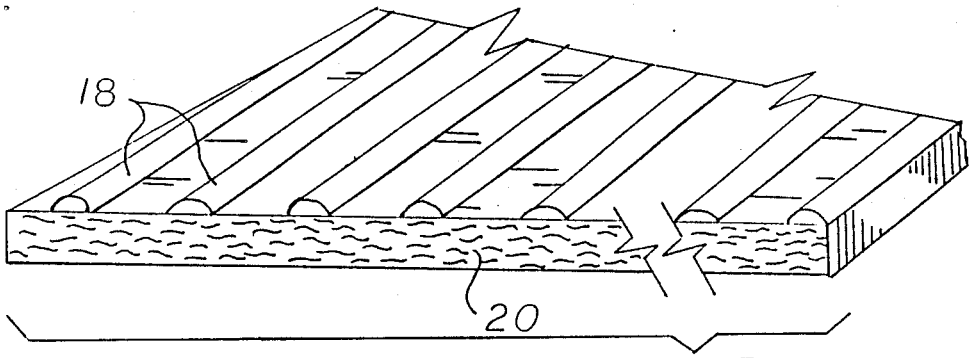

A method for providing the right amount of adhesive over the surface of the fiberboard consists in dispersing the adhesive in longitudinal threads 18 along the fiberboard 20 as shown in FIG. 5. The threads 18 are formed by pumps supplying the adhesive over the fiberboard 20 while the latter moves longitudinally underneath. With this arrangement, it is possible to supply the desired quantity of adhesive, which will adequately penetrate into and spread over the fiberboard to cover the whole surface of the latter. It has been found that known industrial peristaltic pumps can provide the necessary flow control for cold laminating. Threads 18 spaced at about 1 inch having the appropriate cross-section can spread neatly when covered by membrane 12 and extend, practically, over the whole surface without running over the edges of the fiberboard 20.

The membrane 12 may be covered by sand such as rock granules which are well known in roof shingles. Such membranes are not covered by sand along the ledges 22 and 24 which are intended to be overlapped by an adjacent panel. A removable brown kraft paper strip 26 removable by pealing is laid over these ledges 22 and 24 to protect the latter against the adherence of foreign matters and especially when many panels are laid one over the other for storing.

The panels such as shown in FIG. 1 are laid side by side, as shown in FIG. 4, on a roof substrate which is usually a board made of wood. The present invention is also compatible with a wide variety of substrates such as urethane or polyvinyl chloride boards. It can also be applied on building fondations. The panels according to the invention may be adhesively fixed on the substrate or may be fixed with nails 30 having large heads over the ledge 32 when a wooden substrate is used.

The elastomeric membrane has the characteristic of sealing the nails 30 with large heads, mechanical fasteners or the like which may be used for fixing the panels on the substrate. The nails 30 are located along the ledge 32 as shown in FIG. 4. The seal around the nails 30 is completed by the laps such as 36 and 38 corresponding to laps 23 in FIG. 1 which overlap the ledge 32 and to which they are heat-welded. The welding operation is performed on the roof by briefly projecting the flame of a blowtorch over the laps 36 and 38. The laps over the ledges of two superposed panels reach their softening point and solidly bind the membranes together. With this combination of panels, a roof can be made completely waterproof. This result is obtained with only one layer of panels, and a simplified fusing operation. The fusing operation does not necessitate the projection of the flame of the blowtorch between a lower lap and a top edge but on the top of the top ledge only. With this arrangement, the flame does not contact the fiberboard and the elastomer membrane is the only material which is exposed to the flame.

Contrary to the felt material which has been extensively used in the past, as a base for roofing panels, the present elastomer with a polyester base is not flammable. The composition of the panel and its method of installation limit the fire hazard.

The fiberboard used in the present panel absorbs the small surface irregularities. When the new panel needs to override a roof with a change of inclination or an adjacent wall, it is easy for the operator to use a sharp knife to cut the fiberboard layer and bent the panel to follow the desired contour. The imperveousness is maintained by the elastomer layer which is not cut but is only bent to follow the contour.

The panel may also be provided with a membrane having corner 40 (FIG. 1) cut at about 45° over the lap 23 (FIG. 1) so as to reduce the thickness of the melted area of the three overlapping panels 15, 17 and 19 when the later are mounted on the roof.

I claim:

1. A roof covering panel member adapted to be disposed one beside another and be fused in an overlapping relationship for covering a complete roof comprising:

a piece of fiberboard made of agglutinated wood fibers, said fiberboard being rectangular and having a thickness of about ⅜" to 1" and a flammability above 100° C.;

a layer of adhesive selected from hot asphalt or a composition of cold asphalt and latex, said adhesive adapted to maintain its elasticity over a wide range of climatic temperatures;

a membrane having a non-woven reinforcing ply coated with a blended bitumen elastomer fixed on said fiberboard with said adhesive, said membrane having a normally tacky upper surface and a softening point above 100° C., said membrane covering said fiberboard and extending sideways along two adjacent sides of said rectangular fiberboard to form a pair of laps, a pair of peelable strips disposed over a first portion of said tacky surface corresponding to two ledges disposed along two sides opposite said adjacent sides of said fiberboard, a thermofusible plastic film adheringly covering a second portion of said tacky surface remaining from said first portion, said strips and said film adapted to prevent superposed panels from sticking to each other, wherein said laps of the panel member are adapted to overlap and be fused to the ledges of adjacent panels after the peelable strips have been removed.

2. A roof covering panel member as recited in claim 1, wherein the membrane has a thickness of about 1 to 5 mm.

3. A roof covering panel member as recited in claim 1, wherein the membrane has a polyester base.

* * * * *